US006450927B1

(12) United States Patent
Ellis

(10) Patent No.: US 6,450,927 B1
(45) Date of Patent: Sep. 17, 2002

(54) PIVOTING WEIGHT RACK

(75) Inventor: Patrick D. Ellis, Oak Creek, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 0 days.

(21) Appl. No.: 09/706,161

(22) Filed: Nov. 3, 2000

(51) Int. Cl.[7] ..... A63B 21/078
(52) U.S. Cl. ..... 482/94; 482/104
(58) Field of Search ..... 482/92–94, 97, 482/104, 106, 109, 108, 148

(56) References Cited

U.S. PATENT DOCUMENTS 4,302,009 A 11/1981 Johnson
4,602,785 A 7/1986 Rockwell
4,890,831 A 1/1990 Craig
4,928,961 A 5/1990 Madden
5,151,072 A 9/1992 Cone et al.
5,215,510 A 6/1993 Baran
5,217,421 A * 6/1993 Chrysler ..... 482/104
5,281,193 A * 1/1994 Colbo ..... 482/104
5,433,686 A * 7/1995 Marsh ..... 482/104
5,509,876 A 4/1996 Reyes
5,971,898 A 10/1999 Schoolfield

* cited by examiner

*Primary Examiner*—Glenn E. Richman
(74) *Attorney, Agent, or Firm*—Andrus, Sceales, Starke & Sawall, LLP

(57) ABSTRACT

An exercise assistance device in which an exerciser is positioned upon a support platform resting on a support surface includes a support arrangement and first and second uprights disposed on opposite sides of the support platform. Each upright is pivotally mounted at a lowermost end thereof to the support arrangement at a point beneath the support platform and adjacent the support surface between a rearwardly angled storage position, and a nearly vertical lift off position. The uprights include retaining structure on an upward end thereof for maintaining the weight bar in a substantially horizontal position. When the uprights are moved from the storage position to the lift off position and the weight bar is removed from the retaining structure, the uprights will automatically return to the storage position to permit the exerciser to move the weight bar between the raised and lowered positions without interference of the uprights and retaining structure mounted thereon.

12 Claims, 7 Drawing Sheets

PIVOTING WEIGHT RACK

FIELD OF THE INVENTION

This invention relates broadly to an exercise assistance device and, more particularly, pertains to a barbell support platform equipped with movable barbell supporting members for facilitating the unracking of weight therefrom in a manner which will minimize the risk of injury to the exerciser and any spotter aiding the exerciser.

BACKGROUND OF THE INVENTION

Body building, weight lifting and fitness experts are well aware of the many varied exercises which can be performed with a barbell. These include flat bench presses as well as decline and incline bench presses (with the exerciser lying on his back) and seated shoulder presses (with the exerciser seated upright). Typically, these exercises are carried out in conjunction with stationary support frames which include catches or shelves for retaining the barbell at an initial or racked position. As is well known, a pair of spaced apart, barbell uprights having catches or shelves at their upper ends enable an exerciser supported on a bench to unrack the barbell from the catches and move the barbell between raised and lowered positions.

In all of these exercises, the uprights and the catches are generally positioned behind the exerciser's shoulders and on either side of the exerciser's head so that the uprights and catches will not interfere with the raising and lowering of the barbell. As a result of the rearward location of the uprights, the exerciser must reach backwardly to grasp the barbell and remove it from the uprights.

Because the uprights are located rearwardly of the exerciser's head, the exerciser's arms are in an awkward position which reduces the exerciser's strength and control over the barbell and places the exerciser's shoulders in a position susceptible to injury. Although the chance of injury may be alleviated somewhat by a "spotter" aiding the exerciser, it has been found that further risk can be subjected upon the spotter extending his or her reach to place the barbell over the exerciser's shoulder or chest area. In an effort to assist the exerciser (with or without a spotter) in unracking the barbell, there have been a variety of devices which seek to provide easier access to the racked barbell. One such device is disclosed in U.S. Pat. No. 4,302,009 issued Nov. 24, 1981 to Johnson. In this patent, a set of barbell supporting standards is pivotally mounted midway between the ends of the standards to hinge structure at the upper end of the support members attached to a bench. The standards tilt between a vertical storage position and a forwardly angled lift off position. A return means in the form of a counterweight is added to each standard to facilitate the return of the standard to its storage position once the barbell has been removed from the standards in the liftoff position.

Another retractable arm structure is disclosed in U.S. Pat. No. 5,509,876 issued Apr. 23, 1996 to Reyes. In this patent, a weight bar supporting structure includes a user supporting platform and two spaced apart posts. The first end of a weight bar supporting arm is connected to a lug depending from each post. A second end of each arm includes a weight bar supporting cradle and an upwardly extending guide. The arms are movable from a retracted position to a user lift off position. A spring is used to bias each arm when a weight is removed therefrom from the lift off position to the retracted position.

In both of these patents, the pivoting standards are not interconnected so that an exerciser attempting to lift a weight may find that one of the standards or posts could easily drop out of the way leaving the exerciser with a half racked barbell which could be extremely dangerous. Also, it is noted that these and other prior art designs require the addition of a separate return device such as a counterweight, spring or gas cylinder to return the weight supporting standards or posts to their storage position. Additionally, the design of such standards or posts require that they be pivoted over a larger range of movement than desired. Further, the design of such standards or posts necessitates that the catches or shelves for holding the barbell must be inclined at an unreasonably steep angle which might effect the reracking of the barbell following completion of the exercise.

Notwithstanding the prior art, there remains a need for an improved pivoting weight rack which overcomes the problems discussed above, and provides an exercise assistance device which aids an exerciser in unracking a barbell prefatory to a chest or shoulder press.

SUMMARY OF THE INVENTION

It is a general object of the present invention to provide a pivoting weight rack which will assist an exerciser by moving the weight from a storage position to a lift off position before an exercise movement.

It is also an object of the present invention to provide a pivoting weight rack employing a pair of weight supporting pivoting uprights which will automatically return to the storage position following removal of the weight in the lift off position.

It is an additional object of the present invention to provide a pivoting weight rack wherein a pair of weight supporting pivoting uprights will move together at all times between the storage and lift off positions.

It is a further object of the present invention to provide a pivoting weight rack having a pair of weight supporting pivoting uprights which are particularly balanced such that no independent return device is needed to return the uprights to their storage position.

Yet a further object of the present invention is to provide a pivoting weight rack constructed and arranged such that a pair of weight supporting pivoting uprights will pivot through a relatively short range of movement between the storage and lift off positions.

In one aspect of the invention, an exercise assistance device is provided in which an exerciser is positioned upon a support platform resting upon a support surface and is adapted to hold a weight bar with both hands such that both arms repeatedly move between a lowered position in which the bar is located generally above the top of the exerciser s upper torso and a raised position elevated above the exerciser in which the arms are extended. The apparatus includes a support arrangement and first and second uprights disposed on both sides of the support platform. Each upright is pivotally mounted at a lowermost end thereof to the support arrangement at a point beneath the support platform adjacent to the support surface between a rearwardly angled storage position and a nearly vertical lift off position. The uprights include retaining structure on an upper portion thereof for maintaining the weight bar in a substantially horizontal position. When the weights are moved from the storage position to the lift off position and the weight bar is removed from the retaining structure, the uprights will automatically return to the storage position to permit the exerciser to move the weight bar between the raised and lowered positions without interference of the uprights and retaining structure mounted thereon. The uprights are interconnected by a tie bar for assuring the simultaneous movement of the uprights between the storage and lift off positions. Stop structure is provided for limiting the travel of the pivoting uprights. The retaining structure is comprised of a pair of catch plates, each being attached to an outer edge of a respective one of the uprights. Each catch plate is integrally formed with at least one curved catch finger forming a rounded pocket for retaining the weight bar thereon. The uprights are preferably formed with linear tubes.

In another aspect of the invention, a pivoting weight rack is used in conjunction with a support platform disposed upon a support surface for holding and variably positioning a weight bar relative to an exerciser supported on the platform. The rack includes a support arrangement and a pair of weight bar supporting uprights spaced apart on opposite sides of the support platform. Each upright is pivotally mounted about a pivot axis at a lowermost end thereof to the support structure at a point beneath the support platform and adjacent the support surface between a storage position and a lift off position. The storage position is oriented upwardly and rearwardly relative to a vertical axis disposed perpendicularly to the support surface and passes through the pivot axis, and the lift off position is oriented nearly parallel to the vertical axis. A tie bar interconnects the uprights so that the uprights will move together simultaneously between the storage and lift off positions. The tie bar is provided with a forwardly projecting stop post engagable with the support platform to define a forwardmost lift off position and prevent the uprights from attaining a complete vertical attitude relative to the support structure. The support arrangement includes a pair of fixed support members oriented upwardly and rearwardly relative to the support surface, the support members being generally parallel to the uprights when the uprights are in their storage position. Each of the support members is provided with a forwardly projecting stop post engagable with a rear surface of a respective one of the uprights.

A further aspect of the invention contemplates a pivoting weight rack for use with a user supported platform resting on a support surface, a support structure and a pair of weight bar supporting members pivotally mounted relative to the support between a retracted, storage position and an extended, lift off position, each of the weight supporting members having at least one catch for retaining the weight bar therefrom. The invention contemplates an improvement wherein the weight supporting members are pivotally mounted to the support structure at a lowermost end thereof at a point spaced beneath the support platform adjacent to the support surface and are interconnected together by a tie bar to prevent independent return of one of the weight bar supporting members in the event a portion of the weight bar is removed from one of the catches.

A still fir aspect of the invention contemplates a pivoting weight rack for use with a user supported platform resting on a support surface, support structure and a pair of weight supporting members pivotally mounted relative to the support structure to assist the user in unracking the weight from the weight supporting members without interference therefrom. The invention is improved wherein the weight supporting members are pivotally mounted to the support structure at a lowermost end thereof adjacent to a support surface between a rearwardly angled storage position and a nearly vertical lift off position, the weight supporting members being constructed and arranged such that when a weight is removed from the weight supporting members in the lift off position, the weight supporting members will automatically return to the storage position without the need for an independent return structure being associated with the weight supporting members.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
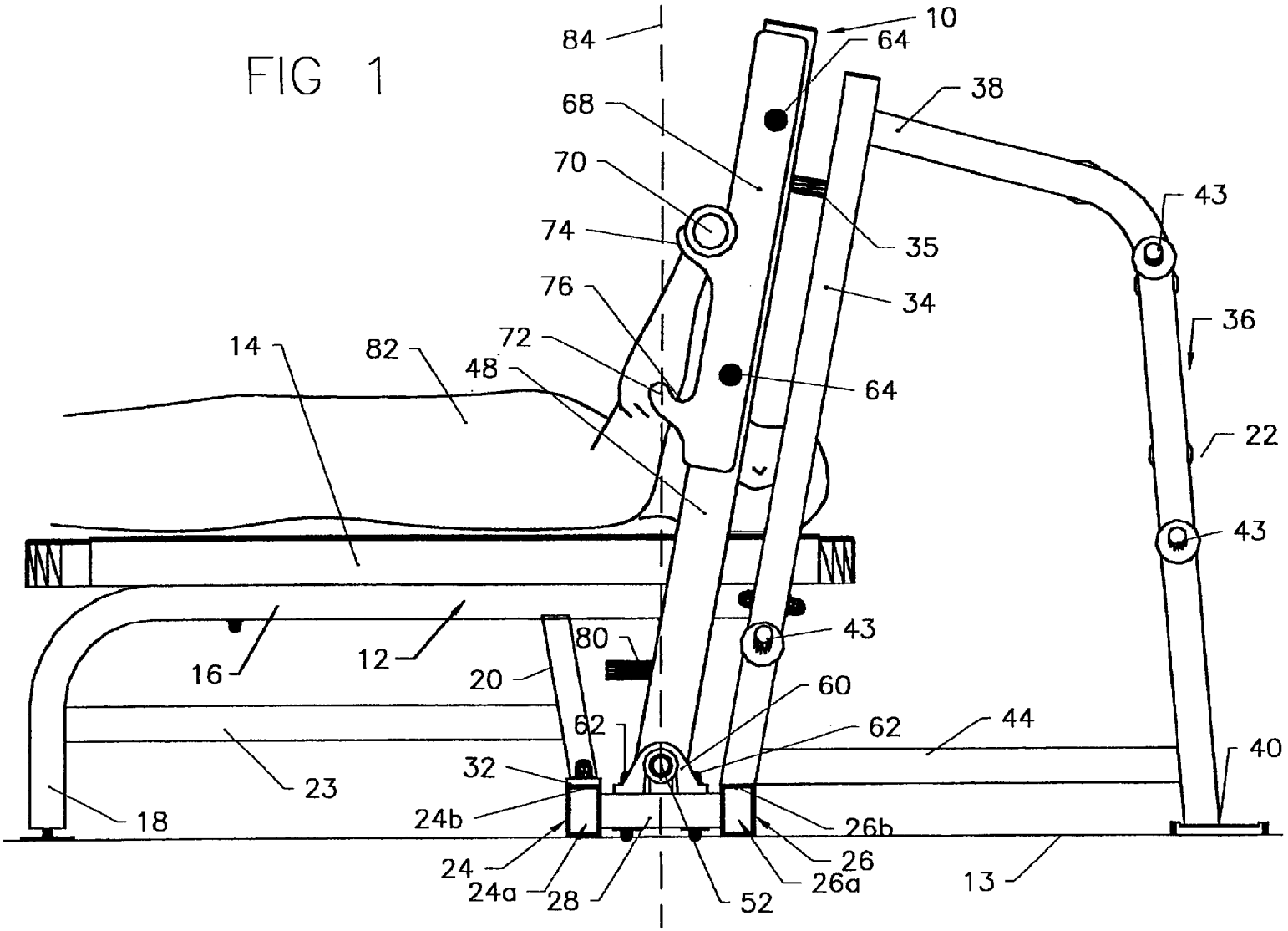
FIG. 1 is a side elevational view of a pivoting weight rack shown in a retracted, storage position.

Referring now to the drawings, FIGS. 1–4 illustrate the general arrangement of a pivoting weight rack 10 embodying the invention as used in conjunction with a supine (horizontal) bench press 12. The bench press rests upon a flat support surface 13 and includes a padded board or support platform 14 which is supported by a curved beam 16 forming a leg 18 at its forward end. The bench press 12 also includes a forwardly inclined strut 20 connected between the bottom of the beam 16 and a support arrangement 22 disposed upon the support surface 13 at a rearward end of the press 12. A horizontal brace 23 runs generally parallel to the bottom of the press 12 and interconnects the front leg 18 and the strut 20 together.

Figure 4:
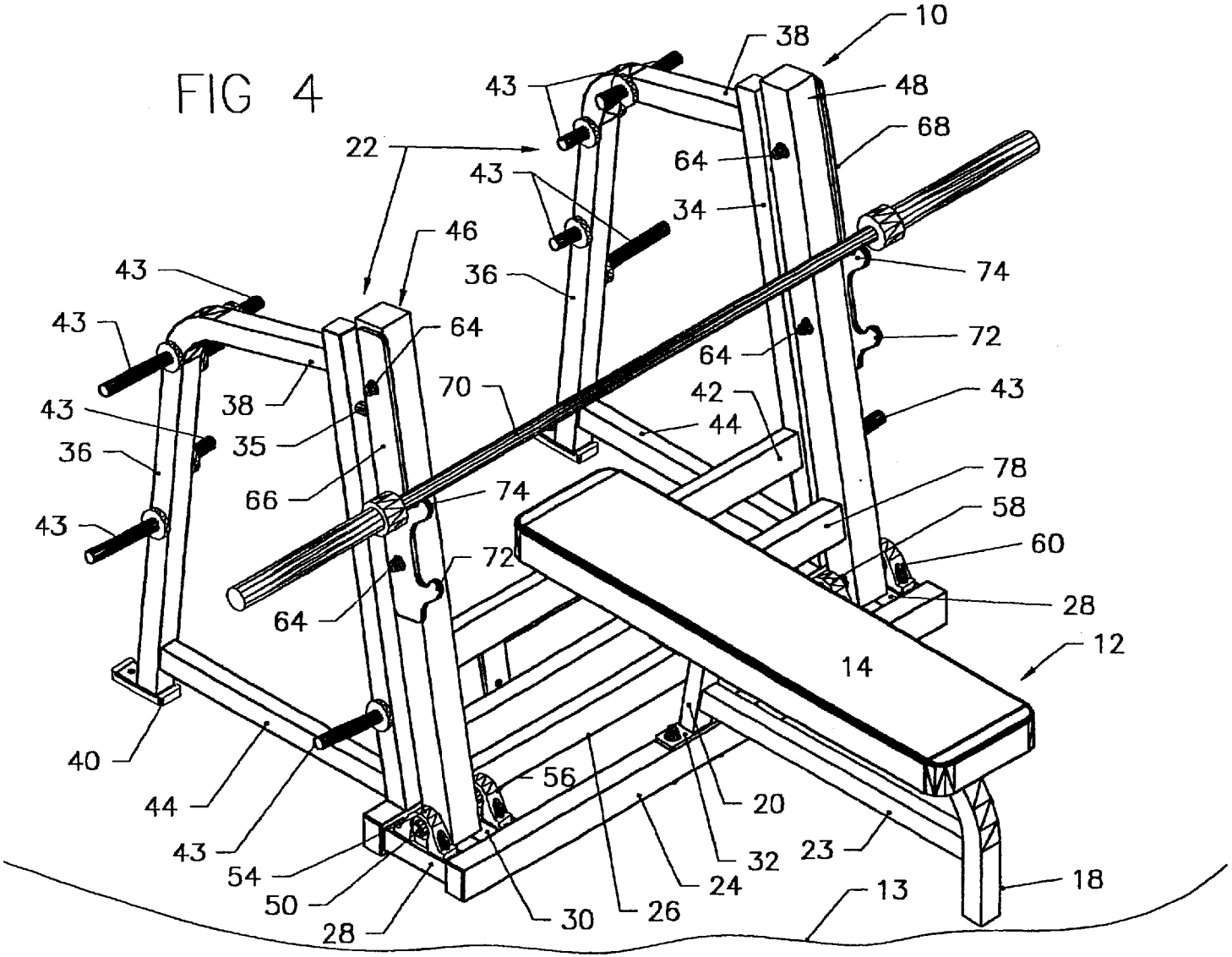
FIG. 4 is a perspective view of a bench press incorporating the pivoting weight rack.

Support arrangement 22 is comprised of a pair of parallel, transverse front and rear base members 24, 26 which are welded or otherwise joined at opposite ends by a pair of parallel connecting bars 28, 30 extending generally perpendicularly thereto. As seen in FIGS. 1 and 4, the base members 24, 26 are preferably in the form of elongated tubes having rectangular cross sections such that their bottom surfaces 24*a* and 26*a* rest on supporting surface 13, and their top surfaces 24*b*, 26*b* define mounting surfaces for surrounding components. In particular, a laterally extending bracket 32 on the lower end of strut 20 is bolted on to the top surface 24*b* in the middle of front base member 24. A rearwardly inclined front support beam 34 is welded to the top surface 26*b* at opposite ends of rear base member 26. Projecting forwardly from the forward side of each front support beam 34 is a fixed stop post 35 which as will be explained below is engagable with components of the pivoting rack 10. A downwardly and rearwardly extending rear support beam 36 is connected to each front support beam 34 such that an upper end 38 is fixed to an upper end of front support beam 34, and a lower end forms a foot 40 disposed flush upon support surface 13. As seen best in FIG. 4, front support beams 34 are secured together by a cross brace 42 which acts as a support for the rear of the bench press board 14. The rear support beams 36 are provided with a series of spaced apart, laterally inwardly and outwardly extending spindles 43 for supporting a plurality of barbell plates (not shown). In order to provide further support, a pair of horizontal beams 44 are connected between the lower ends of front support beams 34 and the lower ends of rear support beams 36.

Figure 2:
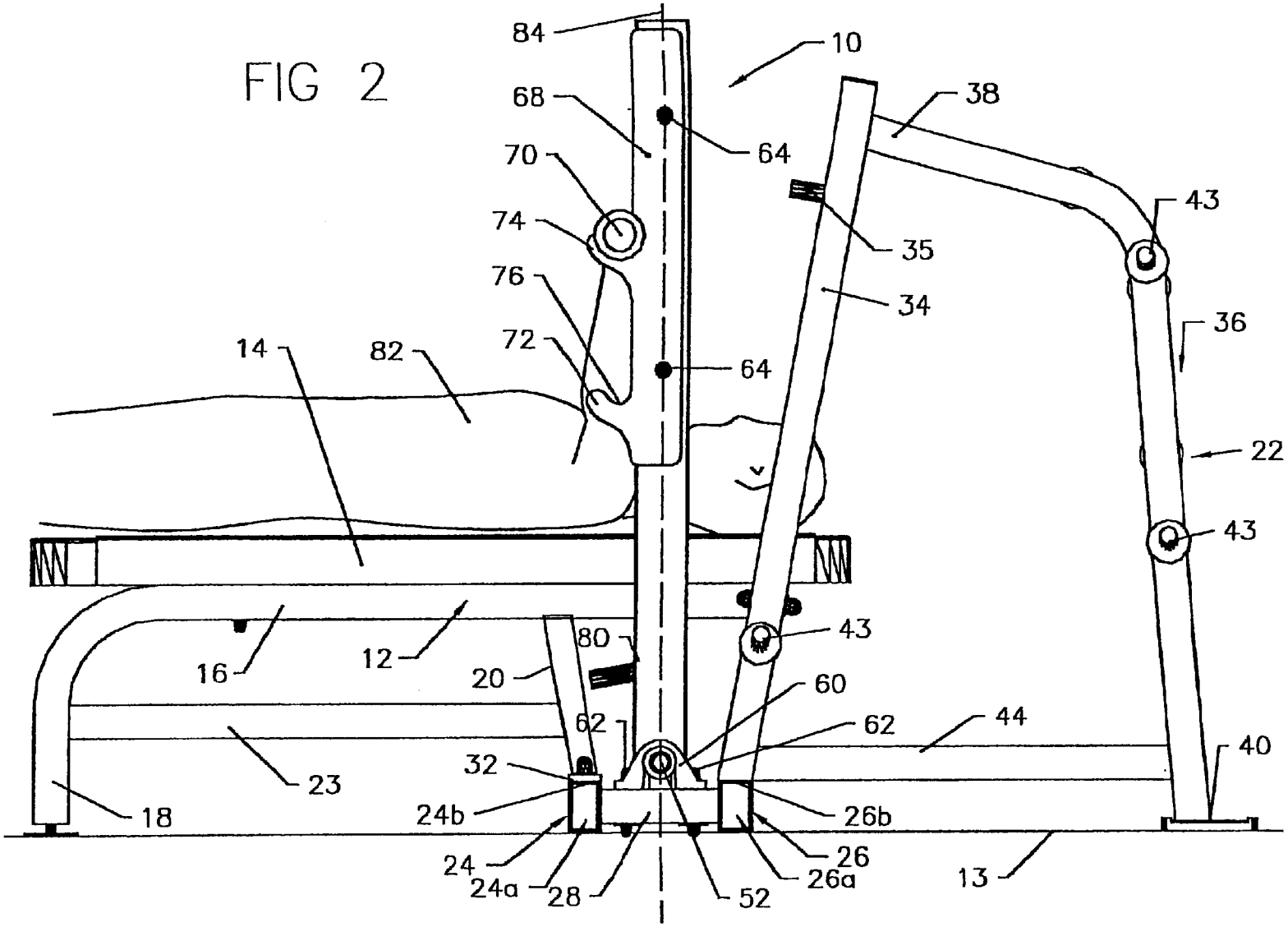
FIG. 2 is a side elevational view of the pivoting weight rack shown in an extended, lift off position.

In accordance with the invention, a pair of elongated, spaced apart, weight supporting uprights 46, 48, preferably in the form of linear tubes, are disposed on each side of the support platform 14 near the rearward end thereof, and pivotally mounted relative to the support structure 22 for movement between a rearwardly angled, retracted, storage position (FIGS. 1 and 3) and a nearly vertical, extended lift off position (FIG. 2). In particular, the lowermost ends of the uprights 46, 48 are pivotally mounted beneath the platform 14 adjacent support surface 13 on respective shafts 50, 52 which pass through the uprights 46, 48 and are retained in spaced apart, pillow block bearings 54, 56, 58, 60 mounted upon connecting bars 28, 30 by fasteners 62. Attached by fasteners 64 to the outer, upper edges of uprights 46, 48 are respective catch plates 66, 68 which serve as retaining structure for enabling racking of a substantially horizontally oriented barbell bar 70. In the drawings, the bar 70 is shown without any barbell plates mounted thereon, but it should be understood that multiple plates of varying increments are normally loaded onto each side of the bar 70 and retained thereon such as by collars. Each of the catch plates 66, 68, has at least two curved, upwardly extending catch fingers 72, 74 which form a rounded pocket 76 (FIG. 1) for retaining the barbell bar 70 therein. As seen in FIG. 4, a tie bar 78 interconnects the lower ends of uprights 46, 48 together. Projecting forwardly from the middle of the tie bar 78 is a movable stop post 80 (FIGS. 1–3) which is engagable with the strut 20 for limiting the forward travel of the pivoting uprights 46, 48.

With reference to FIG. 1, an exerciser 82 is shown lying on the support platform 14 with his or her arms extended upwardly and rearwardly and the exerciser's hands grasped upon the bar 70 as it is racked within the uprights 46, 48 in the storage position. In the storage position, the rear surfaces of pivoting uprights 46, 48 lie against the stop post 35 on the front support beams 34 such that the uprights 46, 48 lie generally parallel to the front support beams 34. The uprights 46, 48 are oriented upwardly and rearwardly relative to a vertical axis 84 disposed perpendicularly to the support surface 13 and passing through the pivot axis of shaft 52. In the preferred embodiment, the uprights 46, 48 lie at about an 80 degree angle to support surface 13.

Figure 3:
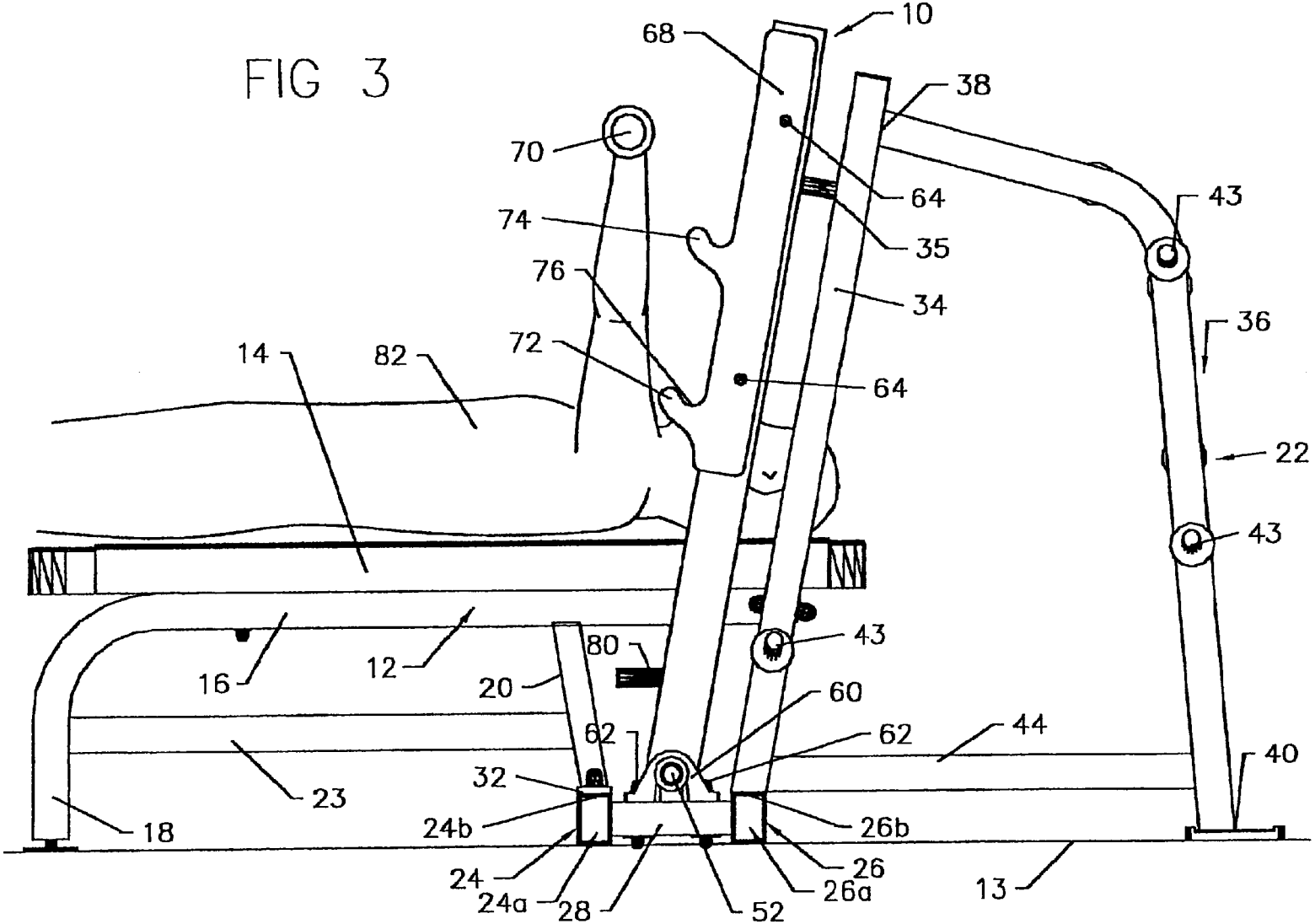
FIG. 3 is a side elevational view of the pivoting weight rack automatically returned to the storage position after the weight bar has been lifted off the rack.

When it is desired to use the pivoting weight rack 10, the exerciser 82 grasping the bar 70 applies a slight forward force so that the uprights 46, 48 will pivot forwardly from the storage position in FIG. 1 to the lift off position in FIG. 2. In the lift off position, it is important to understand that the pivoting uprights 46, 48 are placed in a nearly vertical position (about 87 degrees) relative to the support surface 13. Although the spacing between the end of the stop post 80 and the struts 20 is shown exaggerated in the drawings, it should also be understood that the stop post 80 limits forwardmost travel of the uprights 46, 48 and prevents the uprights 46, 48 from attaining a 90 degree attitude relative to the support surface 13. Once in the lifting position, the exerciser 82 applies an upward force to the bar 70 to disengage the bar 70 from the upper catch fingers 74. Once the bar 70 is unracked, the uprights 46, 48 will both move together (by virtue of tie bar 78) rearwardly and automatically back to the storage position as shown in FIG. 3 so that the exerciser 82 may perform the lift.

The exerciser 82 finishes the lift with the bar 70 held straight above the chest. With the bar 70 in this position, the exerciser 82 can allow his or her arms to swing slightly rearwardly so that the bar 70 will reengage with the catch finger 72 or 74 on the retracted uprights 46, 48.

It is important to recognize that when the uprights 46, 48 are brought to the extended, lift off position and the bar disengages from the catch finger 74, the uprights 46, 48 will always return to the retracted, storage position without the need for an independent return structure such as a counterweight, spring, gas cylinder, etc. being added to the uprights 46, 48. It should further be appreciated that the tie bar 78 prevents independent return of one of the uprights 46, 48 in the event bar 70 is half disengaged from the catch finger 74 in the lift off position. Because of the length of the uprights 46, 48 and the pivotable mounting near the surface 13, the uprights 46, 48 move through a relatively small range of movement (80–87 degrees) which makes it easier to rack and unrack the bar 70. The relative length of the uprights 46, 48 also enables the catch fingers 72, 74 to be made with less of an angular construction to further improve racking and unracking of the bar 70.

Figure 5:
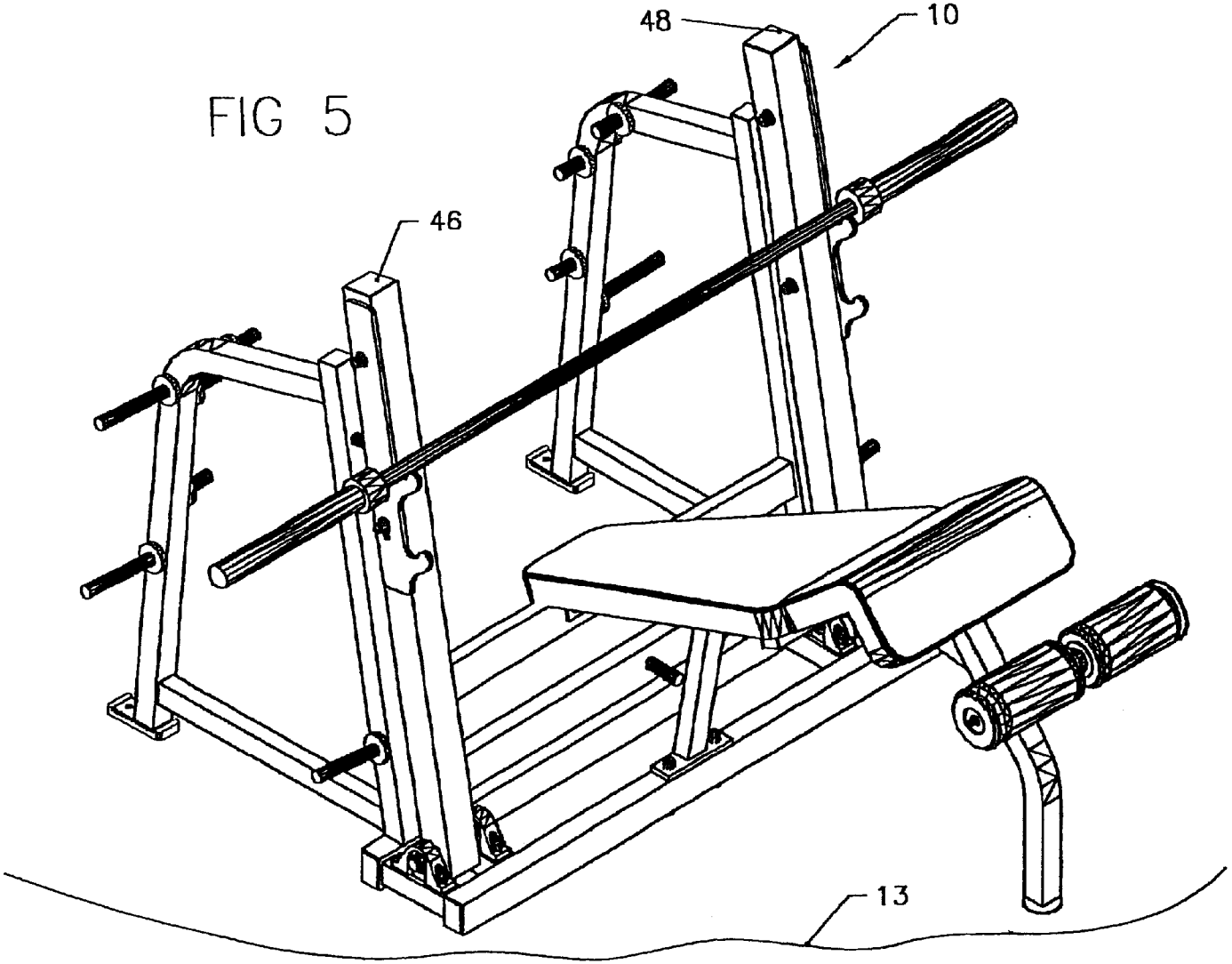
FIG. 5 is a perspective view of a decline bench press incorporating the pivoting weight rack.
Figure 6:
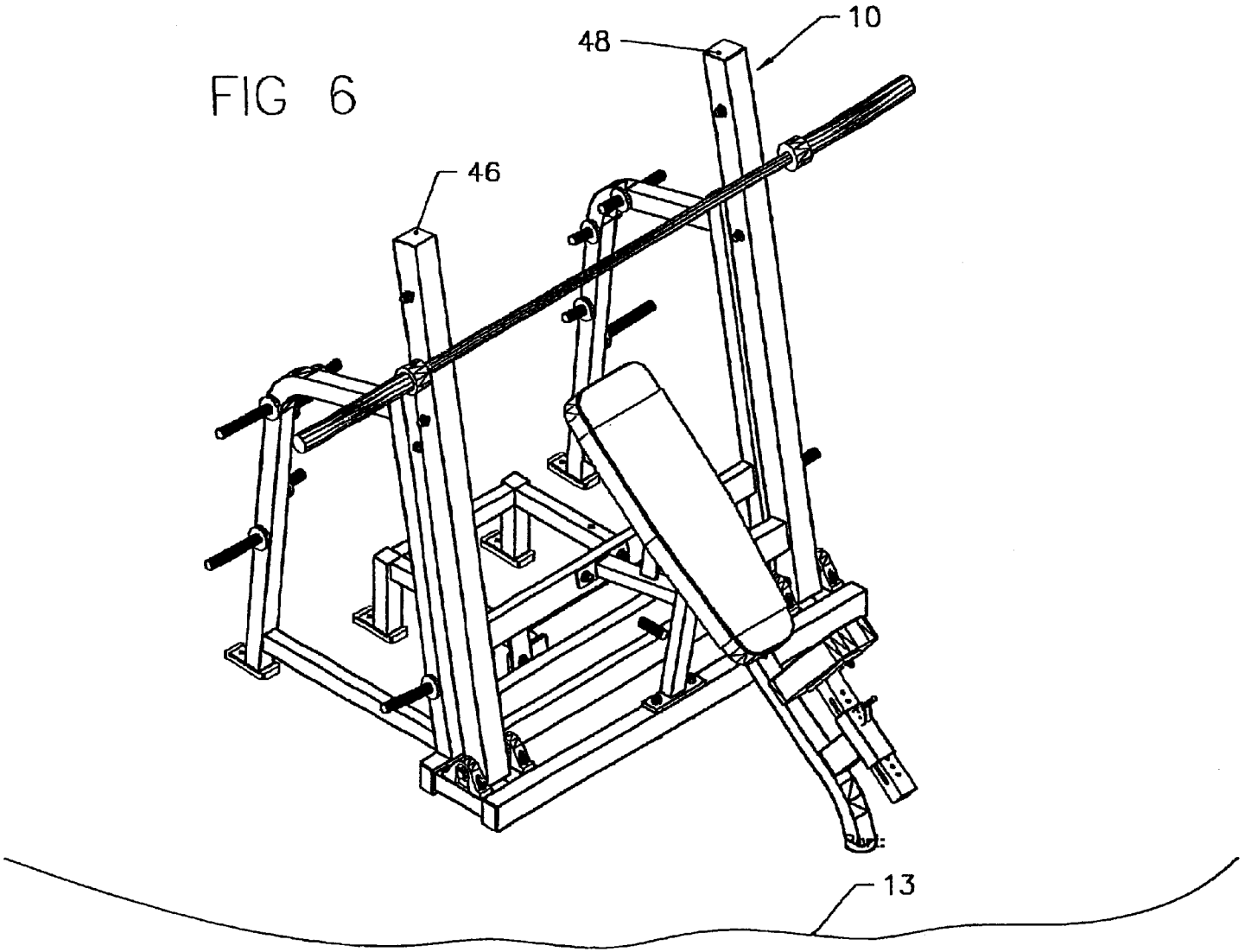
FIG. 6 is a perspective view of an incline press incorporating the pivoting weight rack.
Figure 7:
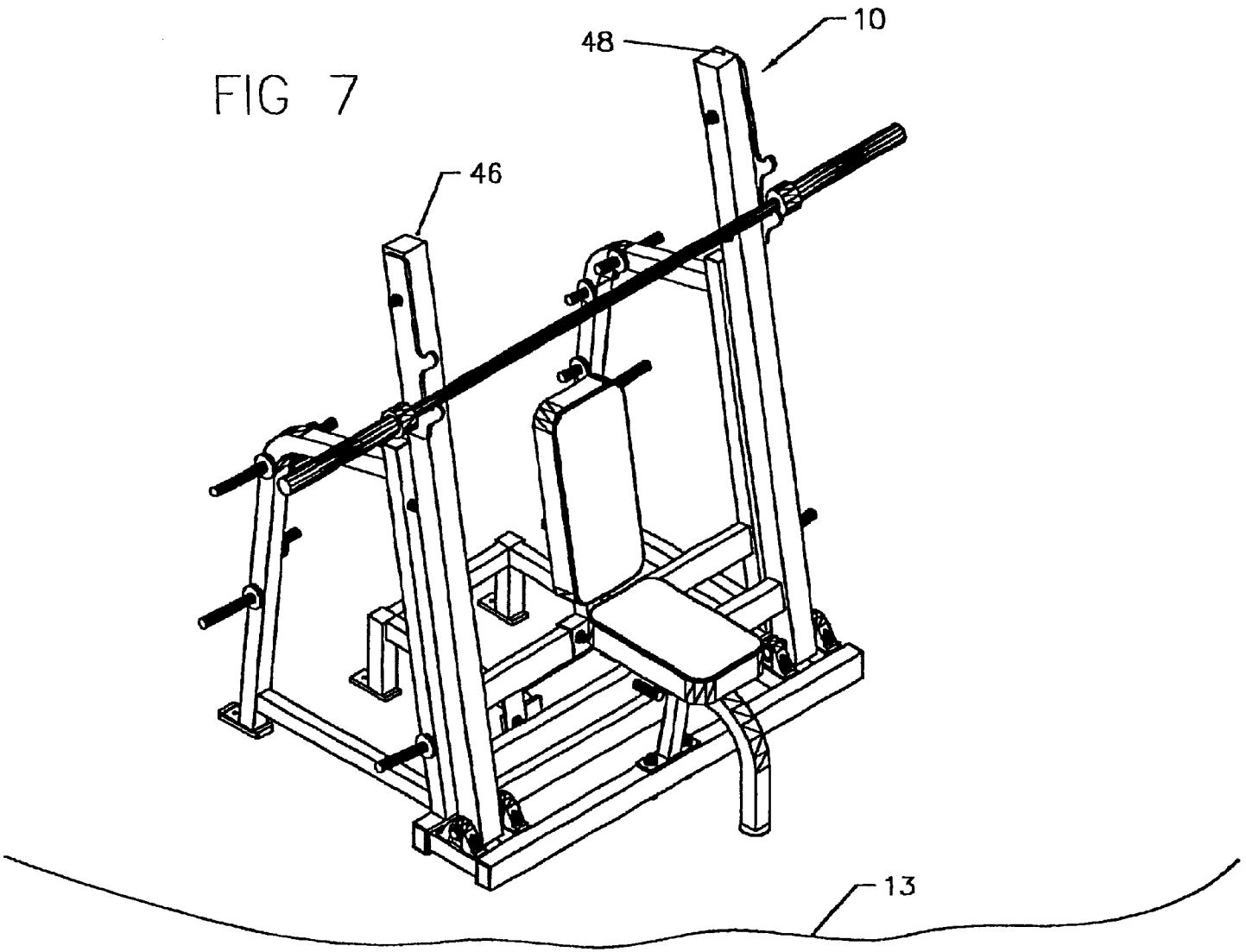
FIG. 7 is a perspective view of a shoulder press incorporating the pivoting weight rack.

Although the invention has been described with reference to a bench press, it should be clearly understood that the pivoting uprights 46, 48 may also be used with other bench supported apparatus such as shown in the decline press of FIG. 5, the incline press of FIG. 6, and the seated shoulder press of FIG. 7.

It is also noted that the exerciser 82 may perform a conventional bench press, as shown in FIGS. 1–4 without using the pivoting motion of the uprights 46, 48; that is, a bar 70 may be unracked directly from the uprights 46, 48 in their storage position.

It should thus be appreciated that the present invention provides a useful device for assisting an exerciser in performing a lifting exercise in a manner which will minimize the risk of injury to the exerciser as well as a spotter at present.

While the invention has been described with reference to a preferred embodiment, those skilled in the art will appreciate that certain substitutions, operations and omissions may be made without departing from the spirit throughout. Accordingly, the foregoing description is meant to be exemplary only, and should not be deemed limitative on the scope of the invention as set forth with the following claims.

I claim:

1. An exercise assistance apparatus in which an exerciser is positioned upon a support platform resting on a support surface and is adapted to hold a weight bar with both hands such that both arms repeatedly move between a lowered position in which the bar is located immediately above a top of the exerciser's upper torso and a raised position elevated above the exerciser in which the arms are extended, the apparatus comprising:

a support arrangement; and first and second uprights disposed on opposite sides of the support platform, each upright being pivotally mounted at a lowermost end thereof to the support arrangement at a point beneath the support platform adjacent the support surface between a rearwardly angled, storage position and a nearly vertical, lift off position, the uprights having retaining structure on an upper portion thereof for maintaining the weight bar in a substantially horizontal position, whereby, when the uprights are moved from the storage position to the lift off position and the weight bar is removed from the retaining structure, the uprights will automatically return to the storage position to permit the exerciser to move the weight bar between the raised and lowered positions without interference of the uprights and retaining structure mounted thereon.

2. The apparatus of claim 1, wherein the uprights are interconnected by a tie bar for assuring the simultaneous movement of the uprights between the storage and lift off positions.

3. The apparatus of claim 1, including stop structure for limiting the travel of the pivoting uprights.

4. The apparatus of claim 1, wherein the retaining structure is comprised of a pair of catch plates, each being attached to an outer edge of a respective one of the uprights.

5. The apparatus of claim 4, wherein each catch plate is integrally formed with at least one curved catch finger forming a rounded pocket for retaining the weight bar therein.

6. The apparatus of claim 1, wherein the uprights are formed with linear tubes.

7. A pivoting weight rack used in conjunction with a support platform disposed upon a support surface for holding and variably positioning a weight bar relative to an exerciser supported on the platform, the rack comprising:

a support structure;

a pair of weight bar supporting uprights spaced apart on opposite sides of the support platform, each upright being pivotally mounted about a pivot axis at a lowermost end thereof to the support structure at a point beneath the support platform and adjacent the support surface between a storage position and a lift off position, the storage position being oriented upwardly and rearwardly relative to a vertical axis disposed perpendicularly to the support surface and passing through the pivot axis, and the lift off position being oriented nearly parallel to the vertical axis; and a tie bar interconnecting the uprights so that the uprights will move together simultaneously between the storage and lift off positions.

8. The pivoting weight rack of claim 7, wherein the tie bar is provided with a forwardly projecting stop post engagable with the support platform to define a forwardmost lift off position and prevent the uprights from attaining a complete vertical attitude relative to the support surface.

9. The pivoting weight rack of claim 7, wherein the support arrangement includes a pair of fixed support members oriented upwardly and rearwardly relative to the support surface, the support members being generally parallel to the uprights when the uprights are in their storage position.

10. The pivoting weight rack of claim 7, wherein each of the support members is provided with a forwardly projecting stop post engagable with a rear surface of a respective one of the uprights.

11. In a pivoting weight rack for use with a user supported platform resting on a support surface, a support structure and a pair of weight bar supporting members pivotally mounted relative to the support structure between a retracted, storage position and an extended lift off position, each of the weight supporting members having at least one catch for retaining the weight bar thereon, the improvement wherein:

the weight supporting members are pivotally mounted to the support structure at a lowermost end thereof at a point spaced beneath the support platform adjacent to the support surface, and are interconnected together by a tie bar to prevent independent return of one of the weight bar supporting members in the event that a portion of a weight bar is removed from one of the catches.

12. In a pivoting rack for use with a user supported platform resting on a support surface, support structure and a pair of weight supporting members pivotally mounted relative to the support structure to assist the user in unracking the weight from the weight supporting members without interference therefrom, the improvement wherein:

the weight supporting members are pivotally mounted to the support structure at a lowermost end thereof adjacent the support surface between a rearwardly angled storage position and a nearly vertical lift off position, the weight supporting members being constructed and arranged such that when a weight is removed from the weight supporting members in the lift off position, the weight supporting members will automatically return to the storage position without the need for an independent return structure being associated with the weight supporting members.

* * * * *